US008777693B2

(12) United States Patent
Shashy

(10) Patent No.: US 8,777,693 B2
(45) Date of Patent: Jul. 15, 2014

(54) COMPRESSION SUPPORT BRA

(76) Inventor: Mary Helen Shashy, Costa Mesa, CA (US)

( * ) Notice: Subject to any disclaimer, the term of this patent is extended or adjusted under 35 U.S.C. 154(b) by 426 days.

(21) Appl. No.: 13/089,691

(22) Filed: Apr. 19, 2011

(65) Prior Publication Data

US 2011/0275276 A1 Nov. 10, 2011

Related U.S. Application Data

(63) Continuation-in-part of application No. 12/773,610, filed on May 4, 2010, now Pat. No. 8,465,341.

(51) Int. Cl.
*A41C 3/00* (2006.01)

(52) U.S. Cl.
USPC ..... 450/66; 450/65

(58) Field of Classification Search
USPC ..... 450/36, 54–58, 38, 39, 65, 66, 68, 450/74–76, 79, 82, 70
See application file for complete search history.

(56) References Cited

U.S. PATENT DOCUMENTS

| | | | | |
|---|---|---|---|---|
| 4,607,640 | A | 8/1986 | McCusker | |
| 4,781,651 | A * | 11/1988 | Ekins | 450/79 |
| 4,816,005 | A * | 3/1989 | Braaten | 450/58 |
| 5,022,881 | A | 6/1991 | Nagy | |
| 5,032,103 | A | 7/1991 | Larsson | |
| 5,863,236 | A | 1/1999 | Johnson | |
| 5,968,003 | A * | 10/1999 | Sisson | 602/75 |
| 6,083,080 | A * | 7/2000 | Lawson et al. | 450/39 |
| 6,110,005 | A | 8/2000 | Stephenson et al. | |
| 6,165,045 | A | 12/2000 | Miller et al. | |
| 6,168,498 | B1 * | 1/2001 | Wagner | 450/58 |
| 6,464,717 | B1 | 10/2002 | Smith et al. | |
| 6,755,717 | B2 * | 6/2004 | Smith | 450/1 |
| 7,144,294 | B2 * | 12/2006 | Bell et al. | 450/20 |
| 7,381,113 | B2 | 6/2008 | Hori | |
| 7,435,155 | B2 * | 10/2008 | Reinisch et al. | 450/59 |
| 7,442,110 | B2 | 10/2008 | Gaudet et al. | |
| 7,731,564 | B2 | 6/2010 | Sanders | |
| 7,758,401 | B2 | 7/2010 | Kelley et al. | |
| 7,909,675 | B1 * | 3/2011 | Rainey | 450/59 |
| 8,075,368 | B2 * | 12/2011 | Puyaubreau | 450/65 |
| 8,172,639 | B2 * | 5/2012 | Swendseid | 450/85 |
| 8,182,310 | B2 * | 5/2012 | Clair et al. | 450/30 |
| 8,221,186 | B2 * | 7/2012 | Policaro et al. | 450/1 |
| 2001/0019933 | A1 * | 9/2001 | Wagner | 450/37 |
| 2004/0259469 | A1 | 12/2004 | Cano | |
| 2005/0255789 | A1 | 11/2005 | Gaudet et al. | |

(Continued)

FOREIGN PATENT DOCUMENTS

| | | |
|---|---|---|
| EP | 1084632 | 3/2001 |
| FR | 2864429 | 7/2005 |

*Primary Examiner* — Gloria Hale
(74) *Attorney, Agent, or Firm* — Feldman Gale, P.A.; Gregory B. Wood

(57) ABSTRACT

A bra for compression stabilizing the breast mass against motion relative to the torso includes a closed cell foam layer having a front, back, sides, and shoulder straps in a pattern to approximately match the contours of a female user's torso. A first fabric layer adjacent to the inner surface of the cell foam layer adjacent to the user's skin, substantially matching the pattern of the closed cell foam fabric layer, provides moisture wicking and comfort. A portion of the closed cell foam fabric layer extends below the breast line and encircles the torso to add motion stabilizing support to the breasts.

19 Claims, 2 Drawing Sheets

(56) References Cited

U.S. PATENT DOCUMENTS

2008/0287036 A1 11/2008 McGuire
2009/0270013 A1* 10/2009 Clair et al. ..... 450/30
2010/0005569 A1 1/2010 Sanders
2010/0105284 A1* 4/2010 Policaro et al. ..... 450/33

* cited by examiner

COMPRESSION SUPPORT BRA

CROSS-REFERENCE TO RELATED APPLICATION

This Application is a Continuation-in-Part of U.S. application Ser. No. 12/773,610, filed May 4, 2010.

TECHNICAL FIELD

The present invention generally relates to women's apparel. More specifically, the present invention is drawn to a bra for providing compression support to stabilize the breast mass relative to the torso, which is particularly advantageous during physical activity, and/or to counter the strain effect of gravity.

BACKGROUND

The breast area has a mobile center of gravity that is offset relative to the upper torso as a whole. The breast may be regarded as a weighted appendage that the body compensates for by adjusting posture and movement to prevent injury. During physical activity, trauma ("injury") to the breast, such as strained tissue or muscle, may occur during abrupt vertical and horizontal motion, such as during jumping or running. The trauma may be temporary (e.g., soreness), or chronic (e.g., permanent damage to breast tissue). Even when a user is not engaged in activity, gravity is capable of causing strain damage, especially if the breasts are large.

Therefore, a bra adapted to provide breast stabilization support, whether during physical activity, or due solely to the effects of gravity, is beneficial.

Implants may lead to greater risk of trauma during physical activity. Implants (in particular silicone implants) may be denser than natural breast tissue and therefore heavier, which can place strain on the skin and breast matter surrounding the implant. Implants are also foreign objects having some mobility, placed either above or underneath the pectoral muscle. Because implants commonly have a structural resiliency greater than human breast tissue, implants can cause a faster breakdown in surrounding breast tissue (e.g., muscles, skin, fat, ligaments, tendons). Therefore, supporting and stabilizing the implants and surrounding tissue against the strain of motion relative to the torso is beneficial.

SUMMARY

Disclosed is a bra, worn to provide stabilizing support during physical activity, such as while engaging in sports, by addressing the breast mass from the point of view of weight management in relation to the torso. The disclosed bra effectively supports the breast area by compression with the torso to make them effectively a single structural entity, thereby eliminating or reducing breast mobility relative to the torso that can result in discomfort and/or trauma.

The bra is made using a first material layer selected to provide strength for firm, uniform stabilizing support during physical exertion while allowing localized expansion or deformation to conform to localized body shape variations. When worn, the stretchable nature of the fabric exerts an inwardly and downwardly directed compressive force around the circumference of the user's torso while at the same time allowing for localized deformations to conform to localized body shape variations. Suitable fabrics for the first material layer include cellular foam fabrics, closed cell foam, and stretchable Lycra® type fabrics or combinations of such fabrics. Such fabrics or a combination of them, allow for localized, resilient deformation of the fabric in response to localized body features and body movement while at the same time maintaining uniform inward pressing support for the breast tissue. Some of these fabrics are not currently used in bras for support, stability or weight induced motion management. By manufacturing the material to control, for example, foam cell size (when foam material is used), elastic stiffness, contouring and thickness, a combination of structural support, stiffness, and elasticity may be obtained that provides for comfort, support and reduced motion induced trauma. Additionally, when a closed cell waterproof foam is used for the first material layer, perforations may added to enable body moisture to escape from the skin to the layer outer surface, and also providing air breathability to the skin.

An example of closed cell foam material is neoprene. Closed cell neoprene fabric is waterproof and has found application in aquatic body wetsuits. Similar to the wetsuit, the disclosed stabilizing bra provides consistent contouring compression. When properly fitted initially, the neoprene foam fabric of the stabilizing bra conforms to the individual's shape, resulting in a customized fit. Because neoprene foam is a closed cell, fast recovery foam, it has a long lifetime against break down or loss of elasticity from wear and pressure.

In an embodiment, one or more neoprene foam panels contour wrap around the upper torso and over the shoulder of the user, then connect in one centralized area, for example, at the front, back, or sides but preferably in the back. This not only results in a stabilizing hugging structure of the breast area, but eliminates disproportionate pressure on the shoulders, back, shoulder blades, and area under the bust. Otherwise, poorly or unsupported breast tissue (especially in large breasts) is often found to be the cause of back and shoulder strain, which can be aggravated by physical activity. By distributing the forces generated by breast motion during physical activity over the upper torso area, breast motion is better synchronized with torso motion, and the stress per unit of torso body surface area is reduced. Of course, the separate panels may be the same fabric or foam panels or each panel may by designed with different resiliently deformable characteristic around the torso region.

A closure system for closing the bra includes a vertical zipper and slide in the back region. In an open position, donning the bra is made easier. The zipper preferentially closes from top to bottom, thereby completing the downward compression and stabilization of the breasts with respect to the torso upon closure. The closure system may be placed at other locations, such as the front or sides, for example but a back location is preferable. An extension affixed to the zipper slide enables convenient reach to open and close the zipper for ease of donning and removal of the bra.

The bra includes a lowered hammock in the front portion to utilize more torso "real estate" to stabilize the breast area. The fabric area both below and above the breasts are extended over the torso surface to provide for compression stabilization of the breast mass center of gravity both closer to the torso and, optionally, compression of the breast mass lower on the torso. The compression acts to stabilize against motion relative to the torso by distribution of compression support over a large body area. In an embodiment, compression downward in the lowered hammock lowers the overall center of gravity of upper body mass distribution. This overall compression toward the torso, and larger torso contact area (both back and front), reduces a disproportionate amount of pressure and stress to the shoulders, back and upper chest that would otherwise occur with a briefer bra covering less torso area.

A size determining measurement includes taking a bustline measurement so that the circumference of the bra is substantially the same as the circumference of the user as measured around the user's bustline with the breasts circumferentially compressed to a user selected compression.

The bra disclosed may be customized and tailored, for example, by contouring the cut of the closed cell foam material at the sides, rear or shoulders by darting and selective cut-outs that are sewn together. The fabric, whether neoprene foam or other locally and resiliently deformable, may also be formed in a shaped sheet to achieve contour. For example, such customization is particularly useful to address the needs of women with a range of breast and torso sizes, and more particularly with large breasts and small frame torsos. Also, the bra may be formed in sections with each section designed of a different material with different resilient or support characteristics.

Accordingly, the invention provides a support bra which is adapted to stabilize breast motion relative to the torso by compression applied around the entire torso during movement.

The invention also provides a support bra which is adapted to stabilize breast motion relative to the torso by inward and downward compression during physical activity.

The invention also provides a bra which does not require any rigid or semi-rigid breast supporting structures, such as, for example, underwires.

DESCRIPTION OF THE FIGURES

For a more complete understanding of the present disclosure, reference is now made to the following descriptions taken in conjunction with the accompanying drawings.

DETAILED DESCRIPTION

Figure 1:
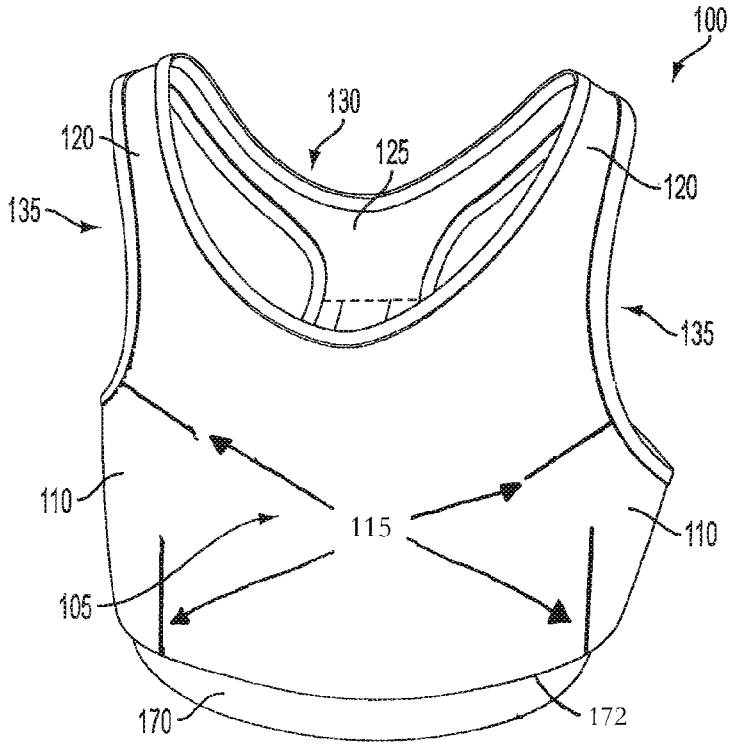
FIG. 1 shows a front perspective view of a support bra in accordance with the disclosure.
Figure 2:
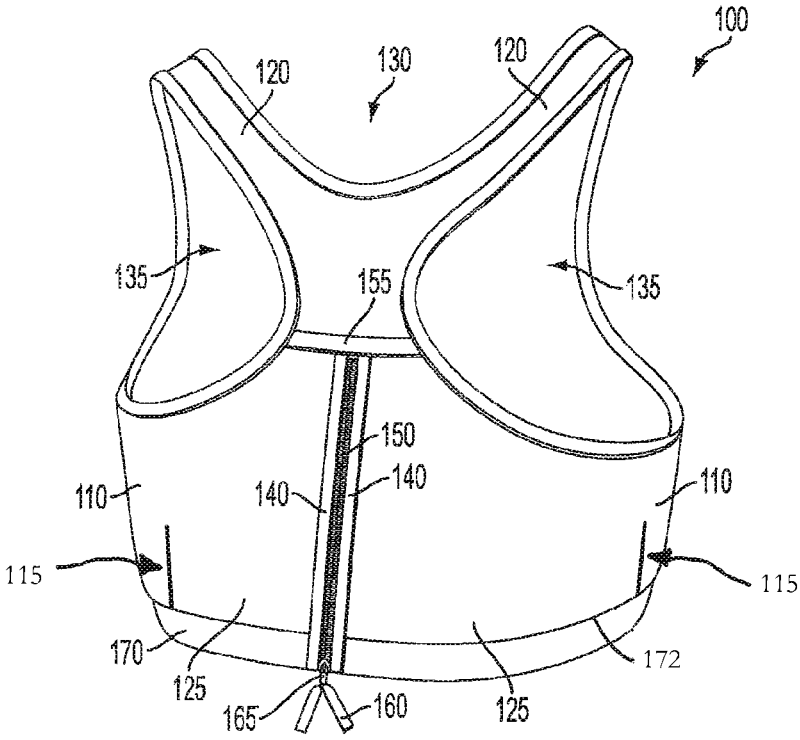
FIG. 2 shows a rear perspective view of the support bra of FIG. 1.

In an embodiment as shown in a front perspective view in FIG. 1 and in a back perspective view in FIG. 2, a bra 100 worn by a user may include a single piece of fabric cut to provide a front 105, sides 110, shoulder straps 120 and a back 125. A cut-out top hole 130 in the cut fabric provides for placement of the finished bra over the head and over the shoulders of the user, and cut-out arm holes 135 on both sides 110 for insertion of the arms therethrough, where portions of the fabric between the top hole 130 and each of the arm holes 135 form the shoulder straps 120 that overlay the user's shoulders.

The bra 100 may be donned by pulling over the user's head through the top hole 130 and inserting the user's arms through the arm holes 135.

A closure system may be included in the bra 100. For example, the back 125 may be closed by bringing together and securing edges of two ends 140 of the back 125 extending from each side by a securement device, such as, for example, a zipper 150 and slider 165, a plurality of hook/eyeloop pairs (not shown), Velcro™, or the like. In an open position of the zipper 150, donning and removing the bra is made easier. In an embodiment using a zipper 150 or zipper-like means of closure, an extension 160 (e.g., string, strap, or the like) may be added to the slider 165 to make an opening and closing manipulation of the zipper 150 and slider 165 easier for the user. Closure of the zipper 150 may be achieved by movement of the slider 165 from top to bottom or, alternatively, from bottom to top. Preferably, closure by top to bottom motion of the slider 165 enables a smooth compression of the breast downward against the torso.

Alternatively, the securement device may be placed elsewhere, for example, at one or more of the sides 110, the front 105, or the like. Alternatively, the bra 100 may not have a securement device (e.g., no zipper 150/slider 165), and is donned without additional means for closure.

The back 125 may further be sewn to a back edge 155 of the fabric defining the top of the zipper 150 and forming and surrounding the top hole 130 to form a seam, thus completing a halter structure that provides support and compressive stability both vertically by elastic stress over the shoulders, and horizontally, by elastic stress from the user's front, around the sides under the arms to the user's back.

The front 105, sides 110 and back 125 of the bra 100 terminate in a bottom edge 172 around the circumference of the bra 100. The bra 100 further included a band 170 attached to the bottom edge 172 so that the band 170 extends around the user below the breast line in contact with the user's torso. Thus, the bra makes use of an additional portion of the torso to provide firmness of contact to the body over a larger torso area via the extended band 170 in order to compressively stabilize the breasts in relation to the torso. The front 105 includes a hammock above the extended band 170 to provide space for compression of the breast in a downward direction on the torso.

The fabric may comprise neoprene, or an equivalent fabric with mechanical properties selected to have suitable elastic strength to provide compressive support to breast tissue, at least partially or substantially immobilizing the breasts relative to the torso during physical movement. Thus, the breasts and torso are contained to behave substantially as a single structure during physical motion to reduce strain and possible trauma to breast tissue, including breasts containing implants.

The neoprene (or equivalent locally and resiliently deformable fabric) may be oversheathed, sewn, bonded or laminated on an inner surface facing the user's body, exterior surface, or both, with a "breathable" fabric to wick moisture (such as perspiration) during physical activity. The breathable fabric may or may not be elastic, and may or may not further contribute to compression stabilization of the breasts. A function of the oversheath fabric includes providing skin contact comfort and moisture breathability (wicking). Exemplary inner and outer oversheath material may include nylon, Lycra®, Spandex™, cotton, blends of these materials, or the like, which have suitable stretch and wicking properties.

All cut edges and seams of the fabric of the bra 100 may be finished for cosmetic appearance and to prevent unraveling and/or fraying at the fabric edges and may be covered between the seams and the user for comfort.

Figure 3:
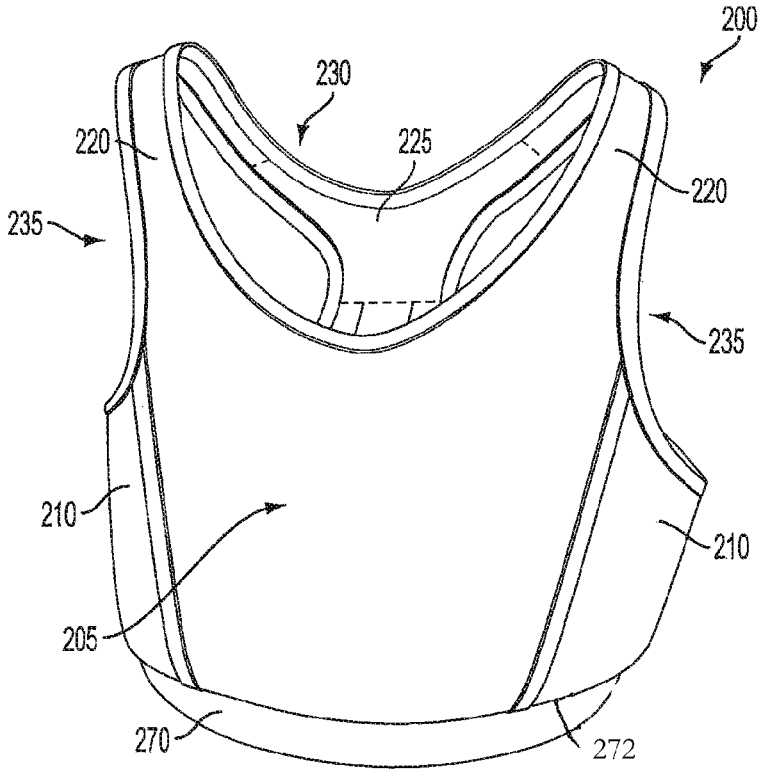
FIG. 3 shows a front perspective view of a support bra fabricated from several panels in accordance with the disclosure.
Figure 4:
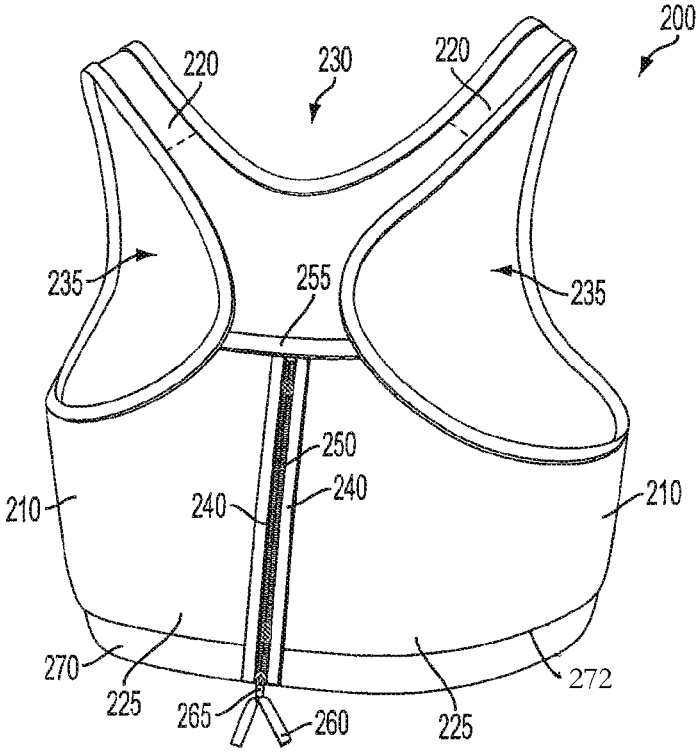
FIG. 4 shows a rear perspective view of the support bra of FIG. 3.

In an embodiment as shown in FIGS. 3 and 4, a bra 200, including front panel 205, sides panels 210 extending around the torso to form a back area 225 and shoulder straps 220 may be of separate pieces that are sewn together, or otherwise joined. Each piece may be the same type of fabric or each may be a different type of fabric but each would have an elastic, locally resiliently deformable character. For example, in one embodiment, the front 205 and shoulder straps 220 may be formed from a first piece of closed cell foam fabric, where the top hole 230 is cut for placing the user's head therethrough, and the sides 210, and back 225 may be cut from another piece of closed cell foam fabric, to be joined at the sides to the first piece, and at the back-side of the bra 200 with a zipper 250 and slider 265, a plurality of hook/eyeloop pairs (not shown) or the like (as described above with reference to the bra 100), joined to the back edge 255 of the portion of bra 200 completing the shoulder straps 220, thereby also forming the arm holes 235 for placing the user's arm's therethrough. Other ways of apportioning the fabric among a plurality of separate parts that are then sewn or otherwise joined together are within the spirit of the disclosure. Additionally, the breathable oversheath fabric may be provided between the user and the plurality of parts of the closed cell foam fabric pieces for comfort and or wicking functionality.

Like the bra 100, the front 205, sides 210 and back 225 of the bra 200 are attached to an extended band 270 preferably sewn or otherwise directly connected to the lower edge 272 of the sides 210, back 225 and front 205 below the breast line to contact a portion of the torso. Also, an extension 260, or the like, may be added to the slider 265 to make opening and closing manipulation of the zipper 250 easier for the user. A flap of fabric on the inside of the bra to cover the zipper may also be included so the surface of the zipper is not in direct contact with the user, an arrangement that could result in user discomfort.

Bras 100, 200 may be customized and tailored, for example, by contouring the cut of the closed cell foam layer material at the sides, rear or shoulders by darting 115 (as shown in FIG. 1) and/or selective cut-outs 135 or 130. The darting may be effected on the closed cell foam layer material only, and not the inner or outer oversheath fabric.

It is to be understood that the present disclosure is not limited to the embodiment described above, but encompasses any and all embodiments within the scope of the following claims.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the embodiments of the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. For example, materials with elastic and tensile properties superior to lycra may be utilized. Accordingly, the appended claims are intended to include within their scope such processes, machines, manufacture, compositions of matter, means, methods, or steps.

What is claimed is:

1. A bra to provide downward compressive stabilizing support to the breasts during movement and/or to counter gravity stress comprising:

a resiliently deformable first fabric layer extending around and approximately matching the contours of the torso of a user for applying downward compressive force around the circumference of the user's torso, the first fabric layer having a front, back, and sides with a bottom edge, the back having a back edge remote from the bottom edge;

a band attached to the bottom edge of the first fabric layer and extending below the breasts and encircling the torso for extending the contact area over which downward compressive force is applied to the user; and a zipper device positioned at the back of the first fabric layer and closeable downwardly from the back edge toward the band along at least a portion of the bra for urging the front of the first fabric layer inwardly and downwardly against the breasts of the user as the zipper device is closed downwardly from the back edge toward the band to thereby compress said user's breasts downwardly to counter movement thereof.

2. The bra of claim 1 further comprising:

a second fabric layer adjacent to an inner surface of the first fabric layer, the second fabric layer being adjacent to the user's skin.

3. The bra of claim 1, further comprising:

a third fabric layer adjacent to an outer surface of the first fabric layer and covering the first fabric layer.

4. The bra of claim 1, wherein the first fabric layer is a single piece of material comprising:

a cut-out top hole in the material for placement of the bra over the user's head to rest on the user's shoulders and forming the shoulder straps;

a pair of left and right cut-out arm holes in the material for placement of each of the user's arms there through; and a rearward edge of the shoulder straps sewn to a top edge of the back.

5. The bra of claim 1, wherein the zipper device extends part way up from the band at the back of the bra.

6. The bra of claim 1, wherein the zipper device is positioned at one or more locations including the back, the front and the sides.

7. The bra of claim 1, further comprising:

an extension attached to the slider to assist in manipulating the zipper for opening and closing.

8. The bra of claim 1, wherein the first fabric layer is closed cell foam.

9. The bra of claim 1 wherein the first fabric layer further comprises:

a plurality of fabric segments arranged and sewn together, the sewn fabric segments arranged to provide a top hole in the fabric for placement of the bra over the user's head to rest on the user's shoulders and forming the shoulder straps; and a pair of left and right arm holes in the fabric for placement of each of the user's arms there through; and a rearward edge of the shoulder straps sewn to a top edge of the back.

10. The bra of claim 9 wherein the plurality of fabric segments are made of the same fabric.

11. The bra of claim 8, wherein the closed cell foam is neoprene.

12. The bra of claim 1, the first fabric being selected to have an elasticity to provide sufficient compression support to the user's breasts to stabilize them against motion relative to the torso during physical activity.

13. The bra of claim 2, wherein the second fabric is at least one of nylon, spandex and cotton, and blends of nylon, spandex and cotton.

14. The bra of claim 3, wherein the third fabric is at least one of nylon, spandex and cotton, and blends of nylon, spandex and cotton.

15. The bra of claim 1, wherein the bra is sized so that the circumference of the bra is substantially the same as the circumference of the user as measured around the user's bustline with the breasts circumferentially compressed to a user selected compression.

16. The bra of claim 1, further comprising a contoured shape formed at the sides, rear or shoulders of the bra by darting and selective cut-outs of the first fabric layer that are joined together at the cut-out edges.

17. The bra of claim 1, further comprising a hammock area in the front above the band.

18. A bra to provide downward compressive stabilizing support to the breasts during movement and/or to counter gravity stress comprising:

a resiliently deformable first fabric layer extending around and approximately matching the contours of the torso of a user, the first fabric layer having a front, back, and sides with a bottom edge the back having a back edge remote from the bottom edge;

a band attached to the bottom edge of the first fabric layer and extending below the breasts and encircling the torso for extending the contact area over which downward compressive force is applied to the user;

a hammock area in the front of the first fabric layer adjacent the band; and a zipper device positioned at the back of the first fabric layer and closeable downwardly from the back edge toward the band along at least a portion of the bra for urging the front of the first fabric layer inwardly and downwardly against the breasts of the user as the zipper device is closed downwardly toward the band.

19. A bra to provide compression and stabilizing support to the breasts of a user during movement comprising:

a front section, a back section with a back edge and having a zipper device along a vertical linear location extending downwardly from the back edge, two side sections between and joining the front section and the back sections to define an enclosed section around the user's torso, and two shoulder straps, each between the front and back sections for extending over the user's shoulders;

at least the front being made from a first fabric layer for applying compression to flatten the breast tissue for suppressing breast movement during exercise, and a band joined with the front, back, and two sides for encircling the torso below the user's breasts.

* * * * *